US007934311B2

(12) United States Patent
Varkey

(10) Patent No.: US 7,934,311 B2
(45) **Date of Patent: *May 3, 2011**

(54) METHODS OF MANUFACTURING ELECTRICAL CABLES

(75) Inventor: Joseph Varkey, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 246 days.

This patent is subject to a terminal disclaimer.

(21) Appl. No.: 12/183,207

(22) Filed: Jul. 31, 2008

(65) Prior Publication Data

US 2009/0038149 A1 Feb. 12, 2009

Related U.S. Application Data

(60) Provisional application No. 60/954,156, filed on Aug. 6, 2007.

(51) Int. Cl.
*H01R 43/00* (2006.01)

(52) U.S. Cl. ..... 29/825; 174/102 R; 174/120 R; 385/101

(58) Field of Classification Search ..... 29/825; 174/102 R, 120 R; 385/101
See application file for complete search history.

(56) References Cited

U.S. PATENT DOCUMENTS

| | | | | |
|---|---|---|---|---|
| 2,604,509 | A * | 7/1952 | Blanchard | 174/108 |
| 3,115,542 | A * | 12/1963 | Palandri et al. | 174/102 R |
| 6,600,108 | B1 * | 7/2003 | Mydur et al. | 174/120 R |
| 7,005,583 | B2 | 2/2006 | Varkey et al. | |
| 7,170,007 | B2 | 1/2007 | Varkey et al. | |
| 7,188,406 | B2 * | 3/2007 | Varkey et al. | 29/825 |
| 7,586,042 | B2 * | 9/2009 | Varkey et al. | 174/102 R |
| 2006/0137898 | A1 | 6/2006 | Kim et al. | |
| 2006/0260739 | A1 | 11/2006 | Varkey | |
| 2007/0107928 | A1 | 5/2007 | Varkey et al. | |
| 2008/0031578 | A1 | 2/2008 | Varkey et al. | |
| 2008/0128152 | A1 | 6/2008 | Varkey et al. | |

* cited by examiner

*Primary Examiner* — C. J Arbes
(74) *Attorney, Agent, or Firm* — Michael L. Flynn; Dave Hofman; Jody Lynn Destafanis

(57) ABSTRACT

A method of forming at least a portion of a cable comprises providing at least one conductor, extruding at least an inner layer of polymeric insulation over the at least one conductor to form a cable conductor core, embedding a plurality of conductors into the inner layer of the cable conductor core, and extruding an outer layer of polymeric insulation over the cable conductor core and the plurality of conductors and bonding the inner layer to the outer layer to form the cable and provide a contiguous bond between the inner layer, the conductors, and the outer layer, wherein embedding comprises heating a one of the inner layer and the conductors prior to embedding the conductors into the inner layer.

34 Claims, 11 Drawing Sheets

METHODS OF MANUFACTURING ELECTRICAL CABLES

CROSS-REFERENCE TO RELATED APPLICATION

This application is entitled to the benefit of, and claims priority to, provisional patent application U.S. 60/954,156 filed Aug. 6, 2007, the entire disclosure of which is incorporated herein by reference.

BACKGROUND OF THE INVENTION

The statements in this section merely provide background information related to the present disclosure and may not constitute prior art. Embodiments of the present invention relates generally to wellbore cables.

In high-pressure wells, wireline is run through one or several lengths of piping packed with grease to seal the gas pressure in the well while allowing the wireline to travel in and out of the well. Insulated stranded conductors typically consist of several wires (typically copper) cabled at a lay angle around a central wire, with one or more layers of polymeric insulation extruded over the bundled strands. The insulation is not able to penetrate into the spaces between the conductor strands. Additional space is typically left between the central strand and the next layer of stranded wires, and between the insulation and the outer surface of the conductor wires, which create a potential pathway for high-pressure downhole gases. When the cable is being pulled out of the wellbore at high speed, these gases can decompress, leading to bulging insulation. If the gases decompress rapidly, this can even cause the insulation to burst, through the phenomenon of explosive decompression.

Problems with gas migration through interstitial spaces are also observed in coaxial cables and individual insulated conductors. In coaxial cables, a central, insulated conductor is covered in a served shield consisting of individual wires ranging in diameter from about 8 mm to about 14 mm. An additional jacket is placed over the served shield, followed by two layers of served armor wire. Because these wires do not "dig in" sufficiently to the central conductor's insulation, individual wires can become raised up above the other wires and "milk back" during the manufacturing process, damaging the cable. Individual wires can also cross over each other, causing high spots in the served shield, which can lead to similar damage. Because the served wires are not firmly affixed to the conductor, compression extrusion of the outer jacket layer would displace the shield wires. The tube extrusion methods that are compatible with unstable served shield wires leave gaps between the served shield and the outer jacket, which provide a pathway for pressurized downhole gas. The cable can be damaged when this pressurized gas is released through weak spots in the jacket through explosive decompression. It also compromises separation between the served shield and the armor wires.

Because the armor wire layers have unfilled annular gaps, gas from the well can migrate into and travel through these gaps upward toward lower pressure. This gas tends to be held in place as the wireline travels through the grease-packed piping. As the wireline goes over the upper sheave at the top of the piping, the armor wires tend to spread apart slightly and the pressurized gas is disadvantageously released.

In seismic cables used in offshore exploration, armors are typically placed around the cable's circumference at 50 to 60% coverage at a high lay angle (i.e., closer to perpendicular to the cable than other cables). Because of the space between the armors, the armors tend to milk or cross over one another during manufacture, and are not uniformly spaced. Non-uniform armor spacing can lead to weak spots in the completed cables. In gun cables, which carry extremely high air pressure, this is particularly disadvantageous.

One potential strategy to seal armor wires and prevent gas migration through the cable is known as "caging." In caging designs, a polymer jacket is applied over the outer armor wire. A jacket applied directly over a standard outer layer of armor wire would essentially be a sleeve; this would be unacceptable under loading conditions. To create a better connection with the inner layers, space is created in the outer armor wire layer by reducing armor wire coverage from 98% to between 50 and 70%.

This type of design has several problems. When the jacket suffers a cut, potentially harmful well fluids enter and are trapped between the jacket and the armor wire, causing it to rust very quickly, which may cause failure if unnoticed and, even if noticed, is not easily repaired. Certain well fluids may soften the jacket material and cause it to swell. This swelling loosens the jacket's connection with the outer armor wire layer. The jacket is then prone to being stripped from the cable when the cable is pulled through packers, or seals, or if it catches on downhole obstructions. The jacket does not provide adequate protection against cut-through. Cut-through allows corrosive well fluids to accumulate in the annular gaps between the core and the first layer of armor wires. To improve bonding between the jacket and the outer armor wires, armor wire coverage must be significantly reduced. This means fewer or smaller outer armor wires are used. As a result, cable strength is also significantly reduced.

Because of the above problems, caged armor designs can only be used currently in piping/coiled tubing systems. Even in those applications, caged armor designs will experience several of the problems mentioned above. One current manufacturing strategy to maintain uniform armor spacing in seismic cables is to place filler rods (consisting of polymeric rods or yarns encased in a polymeric extrusion) between polymer-coated armor wires. While this helps to keep the armor wires in place and maintain spacing during the manufacturing process, it also creates more interstitial spaces between the armor wires and the spacer rods.

SUMMARY OF THE INVENTION

A method forming at least a portion of a cable, comprises providing at least one conductor, extruding at least an inner layer of polymeric insulation over the at least one conductor to form a cable conductor core, embedding a plurality of conductors into the inner layer of the cable conductor core, and extruding an outer layer of polymeric insulation over the cable conductor core and the plurality of conductors and bonding the inner layer to the outer layer to form the cable and provide a contiguous bond between the inner layer, the conductors, and the outer layer, wherein embedding comprises heating a one of the inner layer and the conductors prior to embedding the conductors into the inner layer. Alternatively, heating comprises extruding the inner layer over the at least one conductor and substantially immediately thereafter embedding the plurality of conductors into the freshly extruded inner layer. Alternatively, heating comprises heating the inner layer substantially immediately prior to embedding. Heating the inner layer may comprise exposing the inner layer to an electromagnetic radiation source. Alternatively, the method further comprises cooling the inner layer prior to embedding. Alternatively, heating comprises heating the plurality of conductors prior to embedding. Heating the plurality of conductors may comprise utilizing a heat induction/shaping device. Alternatively, the at least one conductor comprises a single uninsulated strand. Alternatively, the at least one conductor comprises a plurality of conductors. Alternatively, the plurality of conductors comprises one of uninsulated electrical conductors, shield layers, and armor wire layers.

In an embodiment, a method of forming a cable comprises providing at least one conductor cable core having at least an inner layer of polymeric insulation disposed over at least one conductor, providing a plurality of conductors, heating a one of the inner layer and the plurality of conductors, embedding the plurality of conductors into the inner layer of the cable conductor core substantially immediately after heating, and extruding an outer layer of polymeric insulation over the cable conductor core and the plurality of conductors and bonding the inner layer to the outer layer to form the cable and provide a contiguous bond between the inner layer, the conductors, and the outer layer. Alternatively, heating comprises exposing the inner layer to an electromagnetic radiation source. Alternatively, heating comprises heating the plurality of conductors prior to embedding. Heating the plurality of conductors may comprise utilizing a heat induction/shaping device. Alternatively, the plurality of conductors comprises one of uninsulated electrical conductors, shield layers, and armor wire layers. Alternatively, the method further comprises cooling the inner layer prior to embedding.

Alternatively, the method further comprises providing a second plurality of conductors, heating a one of the outer layer and the second plurality of conductors, embedding the second plurality of conductors into the outer layer of the cable substantially immediately after heating, and extruding a second outer layer of polymeric insulation over the cable and the second plurality of conductors and bonding the outer layer to the second outer layer to form the cable and provide a contiguous bond between the inner layer, the conductors, and the outer layer, the second conductors, and the second outer layer.

In an embodiment, a method of forming a cable comprises providing a conductor strand, extruding a first layer of polymeric insulation over the conductor strand to form a cable conductor core, embedding a first plurality of conductors into the first layer of the cable conductor core substantially immediately after extruding the first layer, extruding a second layer of polymeric insulation over the cable conductor core and the plurality of conductors and bonding the inner layer to the second layer to provide a contiguous bond between the inner layer, the conductors, and the second layer, providing a second plurality of conductors, heating one of the second layer and the second plurality of conductors, embedding the second plurality of conductors into the second layer substantially immediately after heating, extruding a third layer of polymeric insulation over the second layer and the second plurality of conductors and bonding the third layer to the second layer to provide a contiguous bond between the second layer, the second conductors, and the third layer, providing a third plurality of conductors, heating one of the third layer and the third plurality of conductors, embedding the third plurality of conductors into the third layer substantially immediately after heating, and extruding a fourth layer of polymeric insulation over the third layer and the third plurality of conductors and bonding the fourth layer to the third layer to form the cable and provide a contiguous bond between each of the layers and the conductors.

Alternatively, heating comprises extruding the second and third layers over the second and third conductors and substantially immediately thereafter embedding the conductors into the freshly extruded second and third layers. Alternatively, heating comprises exposing the second and third layers to an electromagnetic radiation source. Alternatively, wherein heating comprises heating the second and third plurality of conductors prior to embedding. Heating the second and third conductors may comprise utilizing a heat induction/shaping device. Alternatively, the conductor strand comprises a single uninsulated strand.

Alternatively, the first plurality of conductors comprises uninsulated electrical conductors. Alternatively, the first plurality of conductors comprises shield layers. Alternatively, the second plurality of conductors comprises shield layers. Alternatively, the second and third plurality of conductors comprise armor wire layers. Alternatively, the method further comprises cooling the second and third layers prior to heating.

In an embodiment, a method of forming a cable comprises providing at least one conductor cable core, extruding an inner layer of polymeric insulation over the conductor cable core, providing a plurality of conductors, heating a one of the inner layer and the plurality of conductors, embedding the plurality of conductors into the inner layer of the cable conductor core substantially immediately after heating, and extruding an outer layer of polymeric insulation over the inner layer and the plurality of conductors and bonding the inner layer to the outer layer to form the cable and provide a contiguous bond between the inner layer, the conductors, and the outer layer. Alternatively, heating comprises exposing the inner layer to an electromagnetic radiation source. Alternatively, heating comprises heating the plurality of conductors prior to embedding. Heating the plurality of conductors may comprise utilizing a heat induction/shaping device.

Alternatively, the plurality of conductors comprises one of uninsulated electrical conductors, shield layers, and armor wire layers. Alternatively, the at least one conductor core comprises a one of a monocable, a coaxial cable, a triad cable, a quad cable, a hepta cables, and a seismic cable. Alternatively, the at least one conductor core comprises a tape layer disposed on an outer portion thereof.

Alternatively, the method further comprises providing a second plurality of conductors, heating a one of the outer layer and the second plurality of conductors, embedding the second plurality of conductors into the outer layer of the cable substantially immediately after heating, and extruding a second outer layer of polymeric insulation over the outer layer and the second plurality of conductors and bonding the outer layer to the second outer layer to form the cable and provide a contiguous bond between the inner layer, the conductors, and the outer layer, the second conductors, and the second outer layer.

Embodiments of methods provide cables with continuously bonded polymer layers, with substantially no interstitial spaces, for applications ranging from stranded conductors to served shield conductors, to armor wire systems for monocables, coaxial cables, heptacables and seismic cables. With armor wire systems, this may consist of a continuous jacket, extending from the cable core to the cable's outer diameter, while maintaining a high percentage of coverage by the armor wire layers. The jacket system encapsulates the armor wires and substantially eliminates interstitial spaces between armor wires and jacketing (or between conductor strands and insulation) that might serve as conduits for gas migration. Embodiments of methods enable cabled metallic components (such as conductor strands or armor wires) to be applied over and partially embed into slightly melted polymers. The methods include cabling the components over freshly extruded and or semi cooled extruded polymer and/or passing the polymer through a heat source like infrared (IR) substantially immediately prior to cabling, and/or using heat induction to heat the metallic components sufficient to allow them to melt the polymer and partially embed into the polymer's surface and/or using an electromagnetic heat source (for example, infrared waves) to partially melt the jacketing material very soon after each conductor strands or armor wire layer is applied over a jacket layer. This allows conductor strands or armor wires to embed in the polymeric insulation or jacketing materials, locking the armor wires in place and virtually eliminates interstitial spaces. Embodiments also comprise machines for practicing embodiments of the methods including, but not limited to, an armoring machine comprising an armor machine housing having a cable conductor inlet and outlet and at least one spool disposed within the housing and having a supply of armor wire spooled thereon for dispensing the armor wire for cabling, the spool operable to rotate with respect to the housing to allow the cable conductor to pass therethrough.

The method for forming a cable may be used for wireline cables, such as, but not limited to, monocables, coaxial cables, heptacables, quads, triads or pentad and all different seismic cables, slickline cables that incorporate stranded or served metallic members and any other cables. The method may also be applied to insulated conductors to provide gas-blocking abilities.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

Figure 1:
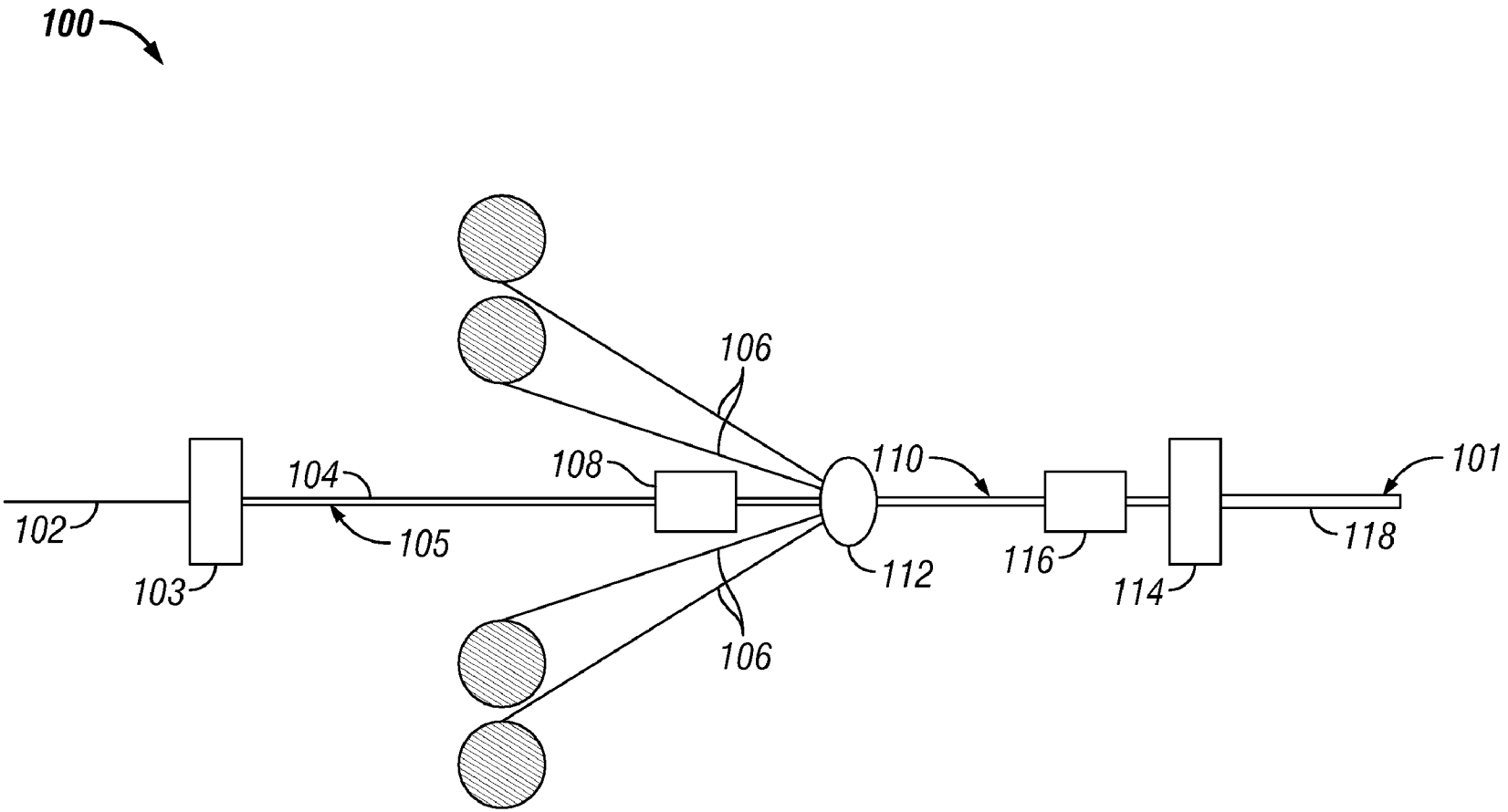
FIG. 1 is a schematic view of a method for forming a cable.
Figure 2A:
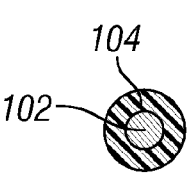
FIGS. 2*a*-2*e* are radial cross-sectional views, respectively, of a cable during various stages of formation during the method of FIG. 1.
Figure 2B:
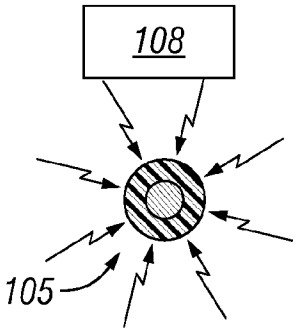
Figure 2C:
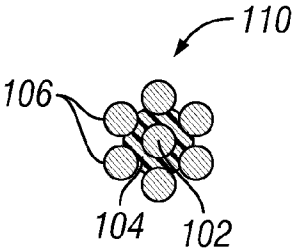
Figure 2D:
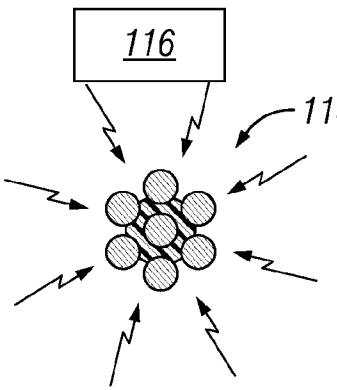
Figure 2E:
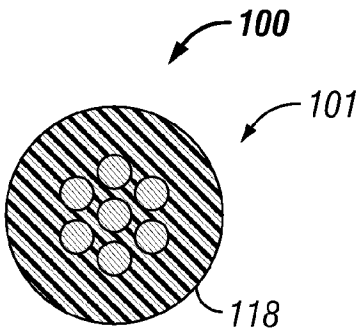
Figure 3:
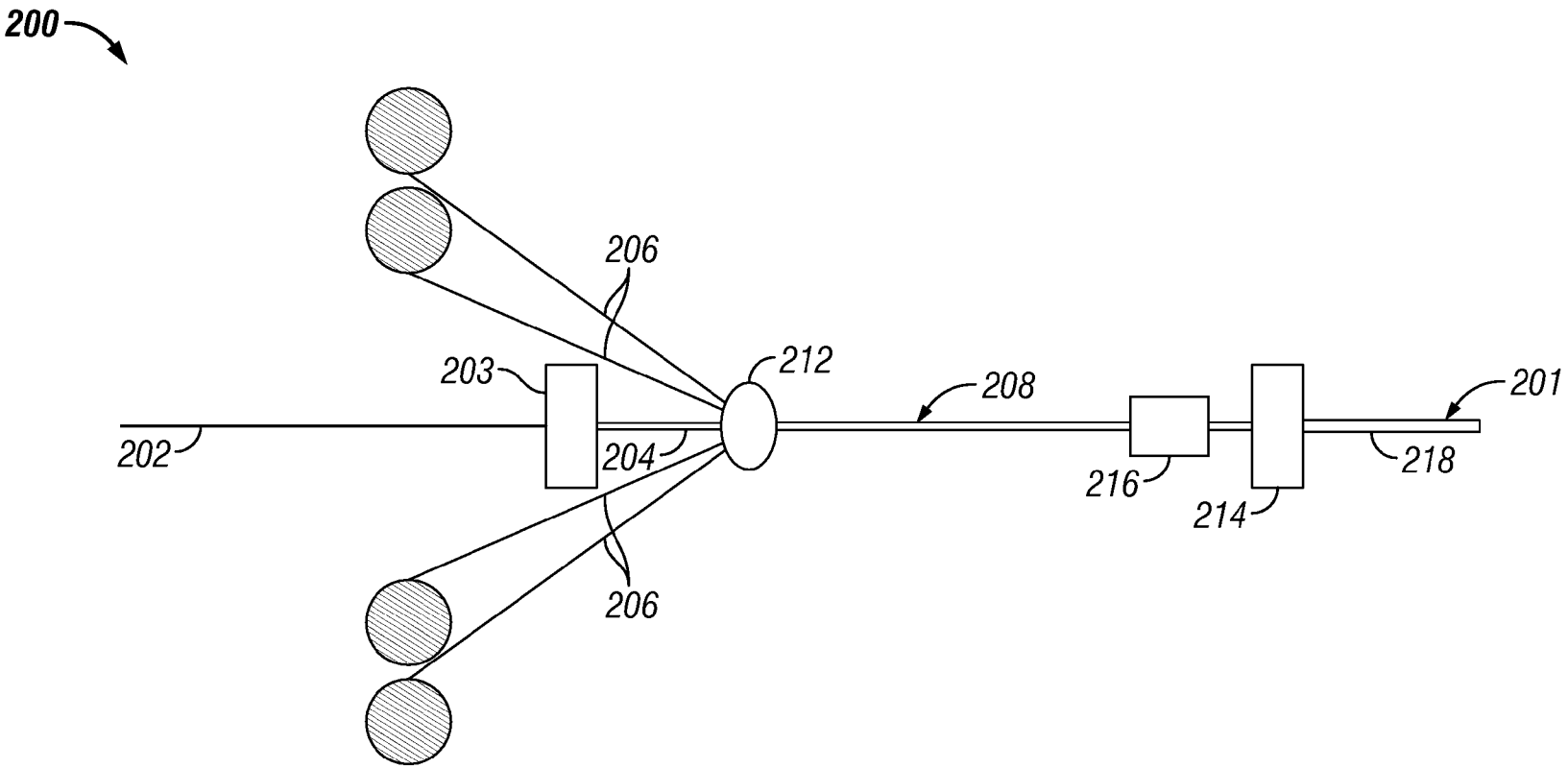
FIG. 3 is a schematic view of a method for forming a cable.
Figure 4A:
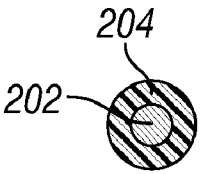
FIGS. 4*a*-4*d* are radial cross-sectional views, respectively, of a cable during various stages of formation during the method of FIG. 3.
Figure 4B:
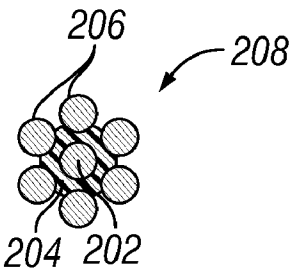
Figure 4C:
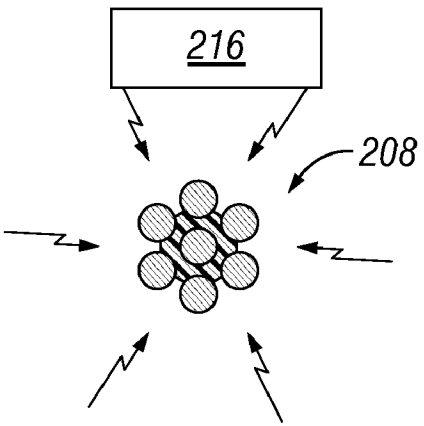
Figure 4D:
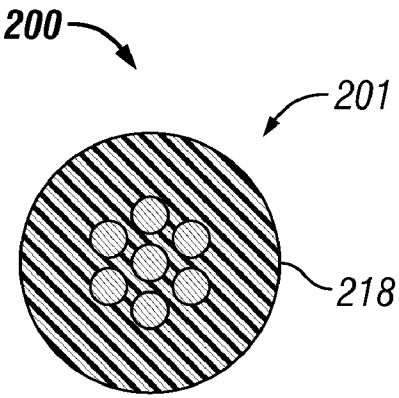

At the outset, it should be noted that in the development of any such actual embodiment, numerous implementation—specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure.

Referring now to FIGS. 1 and 2*a*-2*e*, a method for forming a cable 101 is indicated generally at 100. The method 100 begins by providing, for example, a central coated strand of copper 102, and extruding (by, for example, compression extruding or tube extruding through an extruder 103) a layer of polymeric insulation 104 over the central strand 102 to form a cable conductor core 105. Those skilled in the art will appreciate that the central strand 102 may be, but is not limited to, a coated strand, an uncoated strand, or a preformed cable core comprising a plurality of conductors (such as, but not limited to, a monocable, a coaxial cable, a triad cable, a quad cable, a hepta cables, a seismic cable, or combinations thereof) and coated with a layer of tape (not shown) while remaining within the scope of the present invention. The method 100 may be performed on a separate production line with the central strand 102 spooled for use in at least a second production line that completes the method, discussed in more detail below. Preferably substantially immediately before a plurality of preferably helical copper strands or conductors 106 are applied to continue formation of the cable 101, the cable conductor core 105 passes through a heat source 108, which slightly melts or softens the insulation 104. Heating the insulation 104 prior to application of the strands or conductors 106 is thermodynamically more efficient than heating the combined assembly of central strand 102, insulation 104, and the strands or conductors 106. Next, the preferably un-insulated copper strands 106 are cabled over and partially embedded into the insulation 104 of the central strand 102 at a predetermined lay angle to form a conductor 110 comprising the central strand 102, the insulation 104, and the strands 106. As the strands 106 are cabled, the conductor 110 passes through a closing eye 112 to ensure a circular profile for the cable 101. Immediately prior to entering an extruder 114, the conductor 110 is exposed to a heat source 116, which slightly melts the insulation 104 to facilitate subsequent bonding with the insulation 104. Next, a final layer of insulation 118 is preferably compression extruded over the helical strands 106, bonding through spaces between the strands 106 with the insulation 104 below. The mechanical connection between the inner insulation layer 104 and the outer strands 106 allows the outer layer of insulation 118 to be compression-extruded without causing any damage to or milking of the outer strands 106.

Referring now to FIGS. 3 and 4*a*-4*d*, a method for forming a cable 201 is indicated generally at 200. The method 200 begins by providing, for example, a central coated strand of copper 202, and extruding (by, for example, compression extruding or tube extruding through an extruder 203) a layer of polymeric insulation 204 over the central strand 202 to form a conductor 208. Those skilled in the art will appreciate that the central strand 202 may be, but is not limited to, a coated strand, an uncoated strand, or a preformed cable core comprising a plurality of conductors and coated with a layer of tape (not shown) while remaining within the scope of the present invention. Next, shortly following the extruder 203, a plurality of preferably un-insulated copper strands 206 are cabled over and at least partially embed into the still hot and soft, freshly extruded polymer of the insulation 204 of the conductor 208 at a predetermined lay angle, which forms a conductor 210 comprising the central strand 202, the insulation 204, and the strands 206. Preferably the strands 206 are cabled over the central strand 202 a short predetermined distance from the extruder 203 to enable the freshly extruded polymer of the insulation 204 to retain the heat of the extrusion process and thereby facilitate the embedding of the strands 206 in the insulation 204. As the strands 206 are cabled, the conductor 210 passes through a closing eye 212 to ensure a circular profile for the cable 201. Immediately prior to entering an extruder 214, the conductor 210 may be exposed to a heat source 216, which slightly melts the insulation 204 to facilitate subsequent bonding with the insulation 204. Next, a final layer of insulation 218 is preferably compression extruded over the helical strands 206, bonding through spaces between the strands 206 with the insulation 204 below. The mechanical connection between the inner insulation layer 204 and the outer strands 206 allows the outer layer of insulation 218 to be compression-extruded without causing any damage to or milking of the outer strands 206.

Referring now to FIGS. 5 and 6*a*-6*f*, a method for forming a cable 301 is indicated generally at 300. The method 300 begins by providing, for example, a central coated strand of copper 302, and extruding (by, for example, compression extruding or tube extruding through an extruder 303) a layer of polymeric insulation 304 over the central strand 302. Those skilled in the art will appreciate that the central strand 302 may be, but is not limited to, a coated strand, an uncoated strand, or a preformed cable core comprising a plurality of conductors and coated with a layer of tape (not shown) while remaining within the scope of the present invention. Next, following the extruder 303, a plurality of preferably un-insulated copper strands 306 are cabled over the central strand 302 at a predetermined lay angle to form a conductor 310 comprising the central strand 302, the insulation 304, and the strands 306. Preferably immediately after the helical metallic components or strands 306 are applied, they pass through a heat induction/shaping device 312. For example, electromagnetic heat induction can be applied through a pair of mated, copper rollers 314. The heat induction rapidly heats the metallic components or strands 306. The heated components 306 slightly melt the polymeric surface or the insulation 304 and partially embed into the insulation 304. The mated wheels 314 press the heated metallic components 306 into the polymer 304 and maintain a circular cable profile. As the metallic components 306 are pressed into the polymer 304, the diameter around which they are cabled is slightly decreased. The excess metallic component length created by this change in diameter is transferred back to the spools feeding the metallic components to the process, discussed in more detail below in coverage and excess length equations for a hypothetical monocable. Immediately prior to entering an extruder 316, the conductor 310 may be exposed to a heat source 318, which slightly melts the insulation 304 to facilitate subsequent bonding with the insulation 304. Next, a final layer of insulation 320 is preferably compression extruded over the helical strands 306, bonding through spaces between the strands 306 with the insulation 304 below. The mechanical connection between the inner insulation layer 304 and the outer strands 306 allows the outer layer of insulation 320 to be compression-extruded without causing any damage to or milking of the outer strands 306.

Referring now to FIGS. 7 and 8*a*-8*e*, a method for forming a cable 401 is indicated generally at 400. The method begins by with an insulator cable or conductor 402, such as the cable 101, 201, or 301 shown in FIGS. 1-6 and formed by methods 100, 200, or 300, respectively, and having a layer of insulation 403 thereon. Those skilled in the art will appreciate that the cable 402 may be, but is not limited to, a coated strand, an uncoated strand, or a preformed cable core comprising a plurality of conductors and coated with a layer of tape (not shown) while remaining within the scope of the present invention. Preferably, substantially immediately prior to a plurality of shield wires 404 being applied, the conductor 402 passes through a heat source 406 to slightly melt or soften the insulation 403. The served shield wires 404 are then cabled onto and slightly embedded into the insulation 403 of the conductor 402, forming a cable or conductor 408. As the shield wires 404 are applied, the conductor 408 passes through a closing eye 410 to maintain a circular profile. Immediately prior to an extruder 412, the cable 408 passes through a heat source 414, which slightly melts and softens the insulation 403, to facilitate subsequent bonding with the insulation 403. The extruder 412 compression extrudes polymer 416 over the partially embedded, served wires 404 (and preferably bonds to the insulation 403) to complete the coaxial cable or cable core 401. The completed cable core 401 advantageously has virtually no unfilled interstitial spaces. The jacketing material or polymer 416 may be bonded together from the center 402 to the outer diameter of the insulation 416, if needed, which advantageously ensures reliable isolation of the served wires 404 from the armor wires (not shown), which is normally not achievable in smaller-diameter coaxial cables.

Alternatively, shortly following an extruder (not shown) extruding the layer 403 of insulation to form the cable or conductor 402, the plurality of shield wires 404, are cabled over and at least partially embed into the still hot and soft, freshly extruded polymer of the insulation 404 of the cable or conductor 402 at a predetermined lay angle to form the conductor 408 before proceeding on to the remainder of the steps of the method 400 to form the cable or cable core 401.

Figure 5:
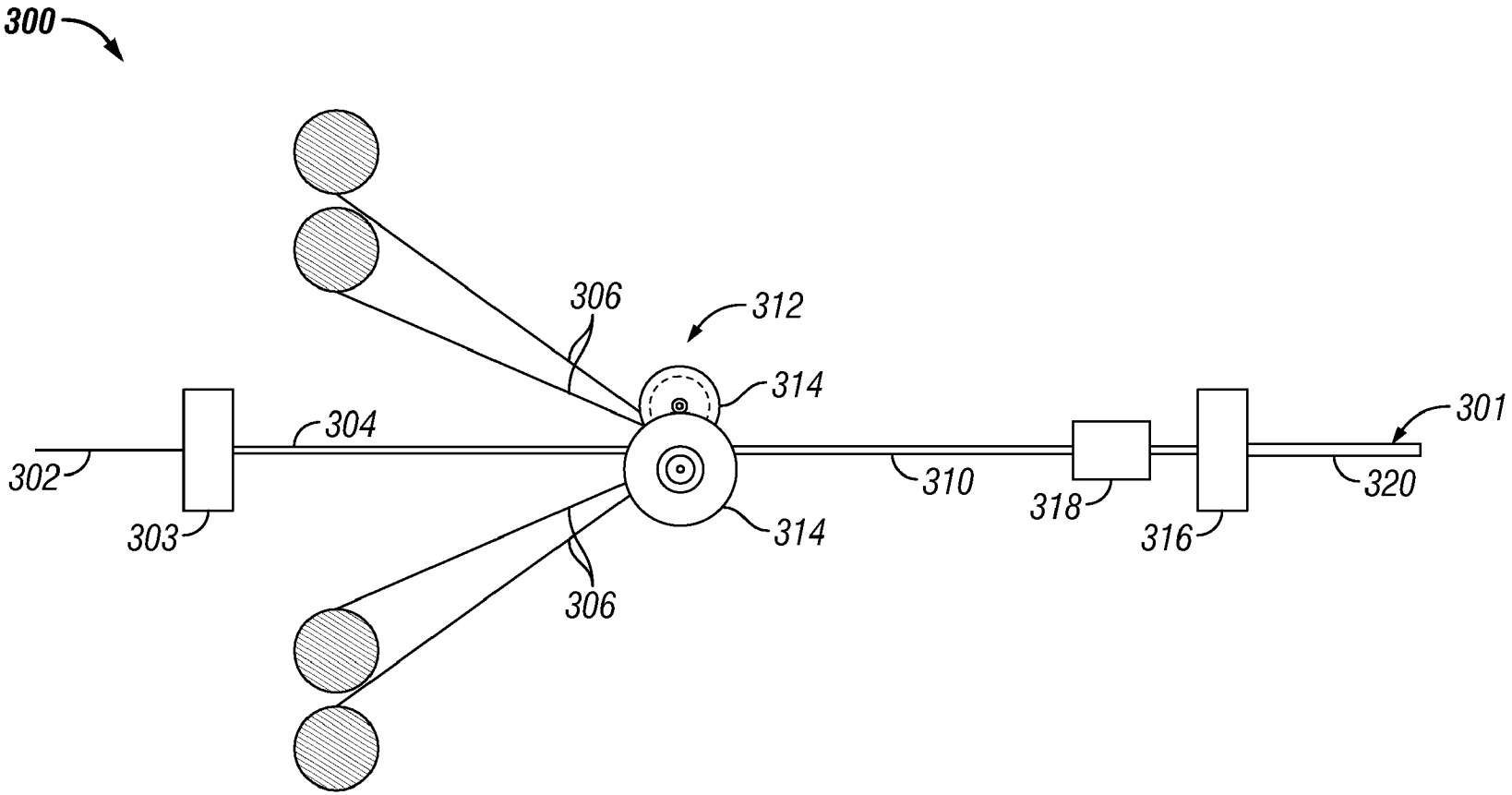
FIG. 5 is a schematic view of a method for forming a cable.
Figure 6C:
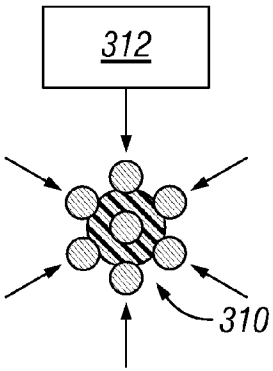
FIGS. 6*a*-6*f* are radial cross-sectional views, respectively, of a cable during various stages of formation during the method of FIG. 5.
Figure 6F:
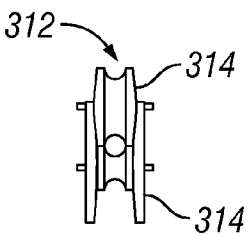
Figure 6B:
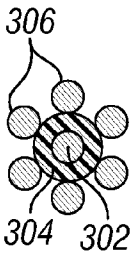
Figure 6E:
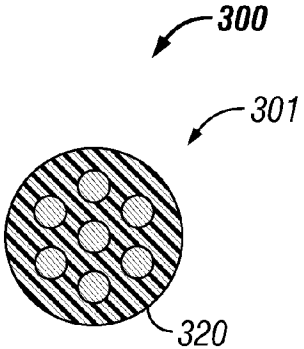
Figure 6A:
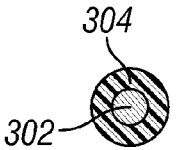
Figure 6D:
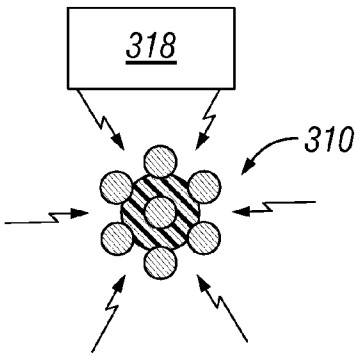

Alternatively, preferably immediately after the shield wires 404 are applied, the conductor 408 passes through a heat induction/shaping device (not shown), such as the heat induction/shaping device 312 and the pair of mated, copper rollers 314 shown in FIG. 5. The heat induction of the heat induction/shaping device rapidly heats the shield wires 404 and the heated wires 404 slightly melt the polymeric surface of the insulation 403 and partially embed into the insulation 403. The mated wheels press the heated shield wires 404 into the polymer 403 to maintain a circular cable profile and as the shield wires 404 are pressed into the polymer 403, the diameter around which they are cabled is slightly decreased, similar to the method 300 recited above before proceeding on to the remainder of the steps of the method 400 to form the cable or cable core 401. The excess wire length created by this change in diameter is transferred back to the spools feeding the wires to the process, discussed in more detail below in coverage and excess length equations for a hypothetical monocable.

Figure 7:
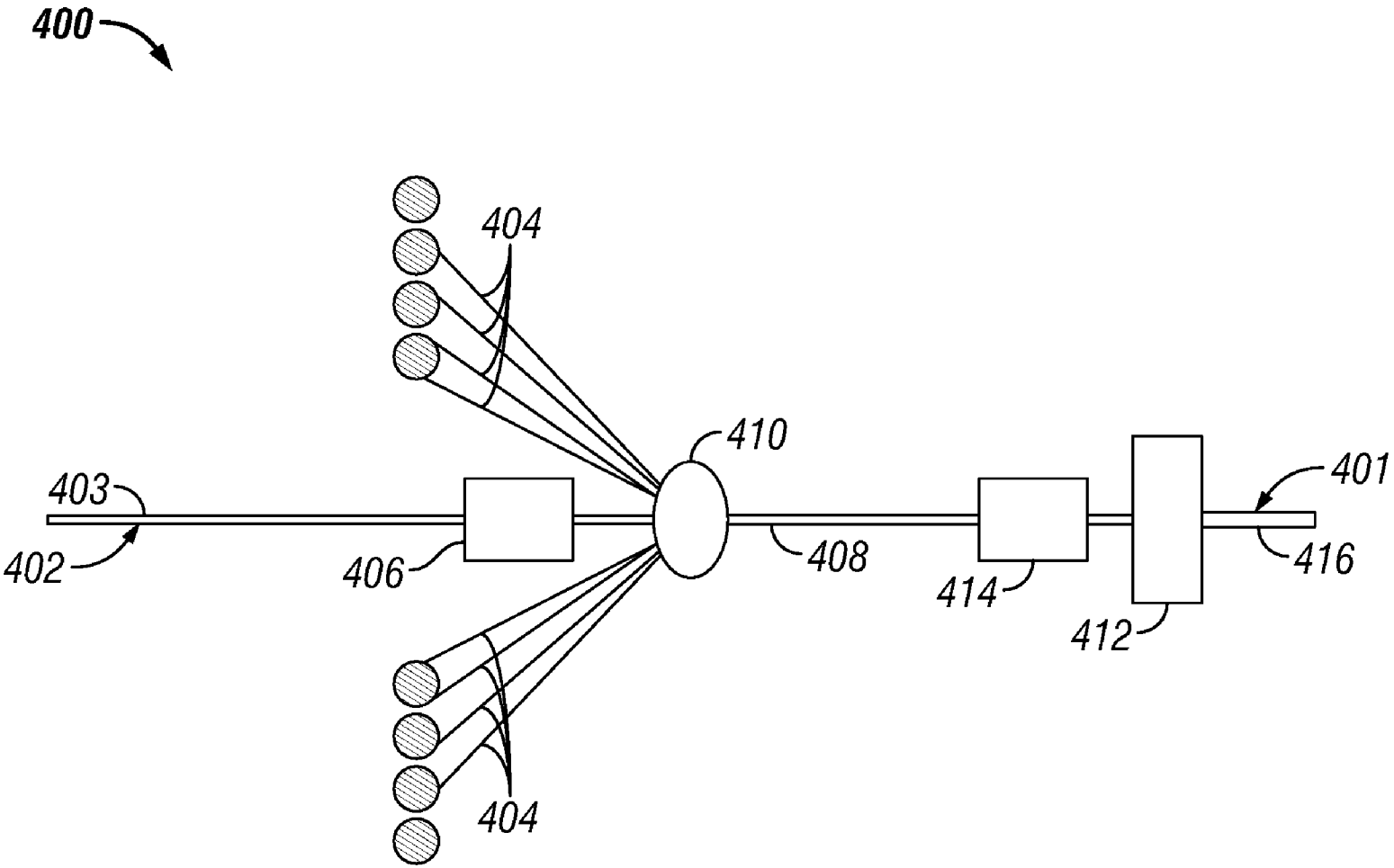
FIG. 7 is a schematic view of a method for forming a cable.
Figure 8C:
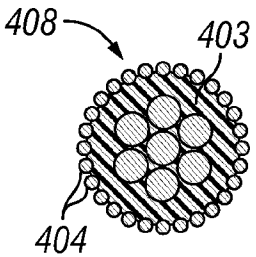
FIGS. 8*a*-8*e* are radial cross-sectional views, respectively, of a cable during various stages of formation during the method of FIG. 7.
Figure 8B:
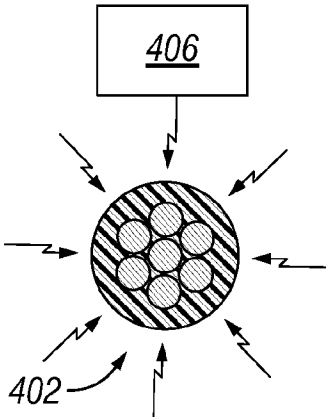
Figure 8A:
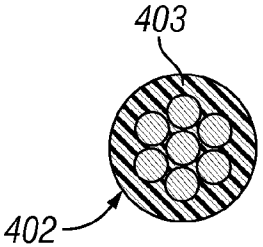
Figure 8E:
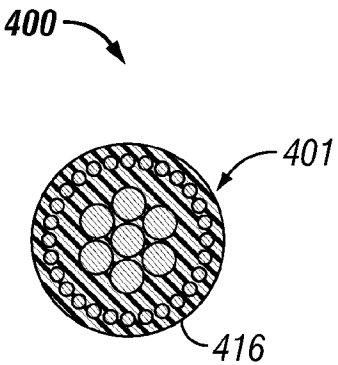
Figure 8D:
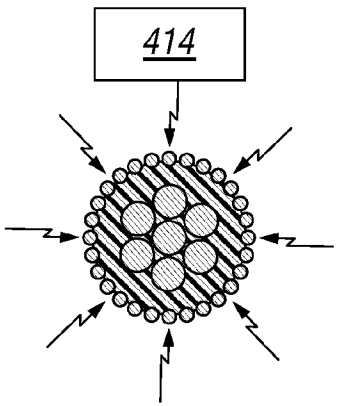

Alternatively, the methods 100, 200, 300, or 400 are utilized to form a cable having a plurality of armor wire layers (not shown) disposed about a cable core, such as the cable 401 shown in FIGS. 7-8*e* by substituting, for example, armor wires for the shield wires 404 shown in FIGS. 7-8*e* and embedding the armor wires in the polymer by passing the polymer through a heat source, by embedding the armor wires into freshly extruded polymer, or by passing the conductor through a heat induction/shaping device, to form a conductor, such as the conductor 408, as will be appreciated by those skilled in the art. Furthermore, additional extruders may be utilized to form multiple layers of armor wire and insulation and embedding the armor wire into insulation utilizing at least one of the heat source, freshly extruded polymer and the heat induction/shaping device. The cable or cables, for example, may be formed for use in the outer jacketing of a gun cable used in seismic exploration.

Figure 9:
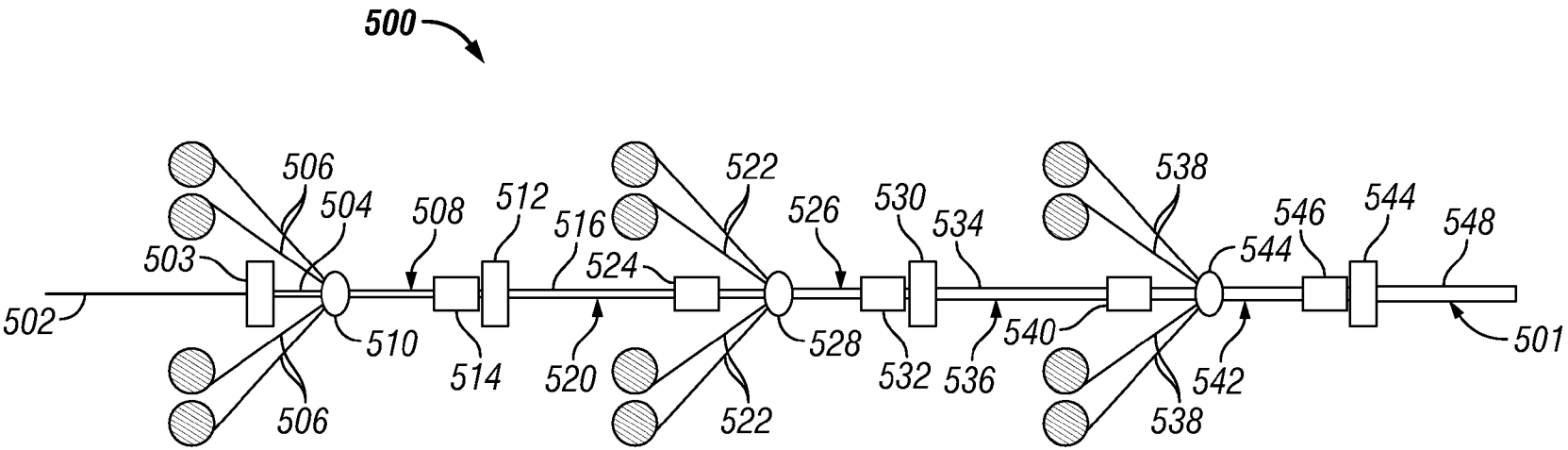
FIG. 9 is a schematic view of a method for forming a cable.

Referring now to FIG. 9, a method for forming a cable 501 is indicated generally at 500. The method 500 begins by providing, for example, a central strand of copper 502, and extruding (by, for example, compression extruding or tube extruding through an extruder 503) a layer of polymeric insulation 504 over the central strand 502. Those skilled in the art will appreciate that the central strand 502 may be, but is not limited to, a coated strand, an uncoated strand, or a preformed cable core comprising a plurality of conductors and coated with a layer of tape (not shown) while remaining within the scope of the present invention. Next, shortly following the extruder 503, a plurality of preferably un-insulated copper strands 506 are cabled over and at least partially embed into the still hot and soft, freshly extruded polymer of the insulation 504 of the central insulated strand 502 at a predetermined lay angle, which forms a conductor 508 comprising the central strand 502, the insulation 504, and the strands 506. Preferably the strands 506 are cabled over the central strand 502 a short predetermined distance from the extruder 503 to enable the freshly extruded polymer of the insulation 504 to retain the heat of the extrusion process and thereby facilitate the embedding of the strands 506 in the insulation 504. As the strands 506 are cabled, the strand 502, the insulation 504, and the strands 506 pass through a closing eye 510 to ensure a circular profile for the cable 501. Immediately prior to entering an extruder 512, the conductor 508 is exposed to a heat source 514, which slightly melts the insulation 504 to facilitate subsequent bonding with the insulation 504. Next, a further layer of insulation 516 is preferably compression extruded over the helical strands 506, bonding through spaces between the strands 506 with the insulation 504 below to form a conductor 520. The mechanical connection between the inner insulation layer 504 and the outer strands 506 allows the outer layer of insulation 516 to be compression-extruded without causing any damage to or milking of the outer strands 506.

Next, preferably immediately before a plurality of preferably helical armor wires 522 are applied to continue formation of the cable 501, the conductor 520 passes through a heat source 524, which slightly melts or softens the insulation 516. Next, the armor wires 522 are cabled over and partially embedded into the insulation 516 of the conductor 520 at a predetermined lay angle to form a conductor 526 comprising the conductor 520 and the armor wires 522. As the armor wires 522 are cabled, the conductor 526 passes through a closing eye 528 to ensure a circular profile for the cable 501. Immediately prior to entering an extruder 530, the conductor 526 is exposed to a heat source 532, which slightly melts the insulation 516 to facilitate subsequent bonding with the insulation 516. Next, a further layer of insulation 534 is preferably compression extruded from the extruder 530 over the armor wires 522, bonding through spaces between the wires 522 with the insulation 516 below to form a conductor 536.

Next, preferably immediately before a plurality of preferably helical armor wires 538 are applied to continue formation of the cable 501, the conductor 536 passes through a heat source 540, which slightly melts or softens the insulation 534. Next, the armor wires 538 are cabled over and partially embedded into the insulation 534 of the conductor 536 at a predetermined lay angle to form a conductor 542 comprising the conductor 536 and the armor wires 538. As the armor wires 538 are cabled, the conductor 542 passes through a closing eye 544 to ensure a circular profile for the cable 501. Immediately prior to entering an extruder 544, the conductor 542 is exposed to a heat source 546, which slightly melts the insulation 534 to facilitate subsequent bonding with the insulation 534. Next, a further layer of insulation 548 is preferably compression extruded from the extruder 544 over the armor wires 538, bonding through spaces between the wires 548 with the insulation 534 below to form a cable 501.

Figure 10:
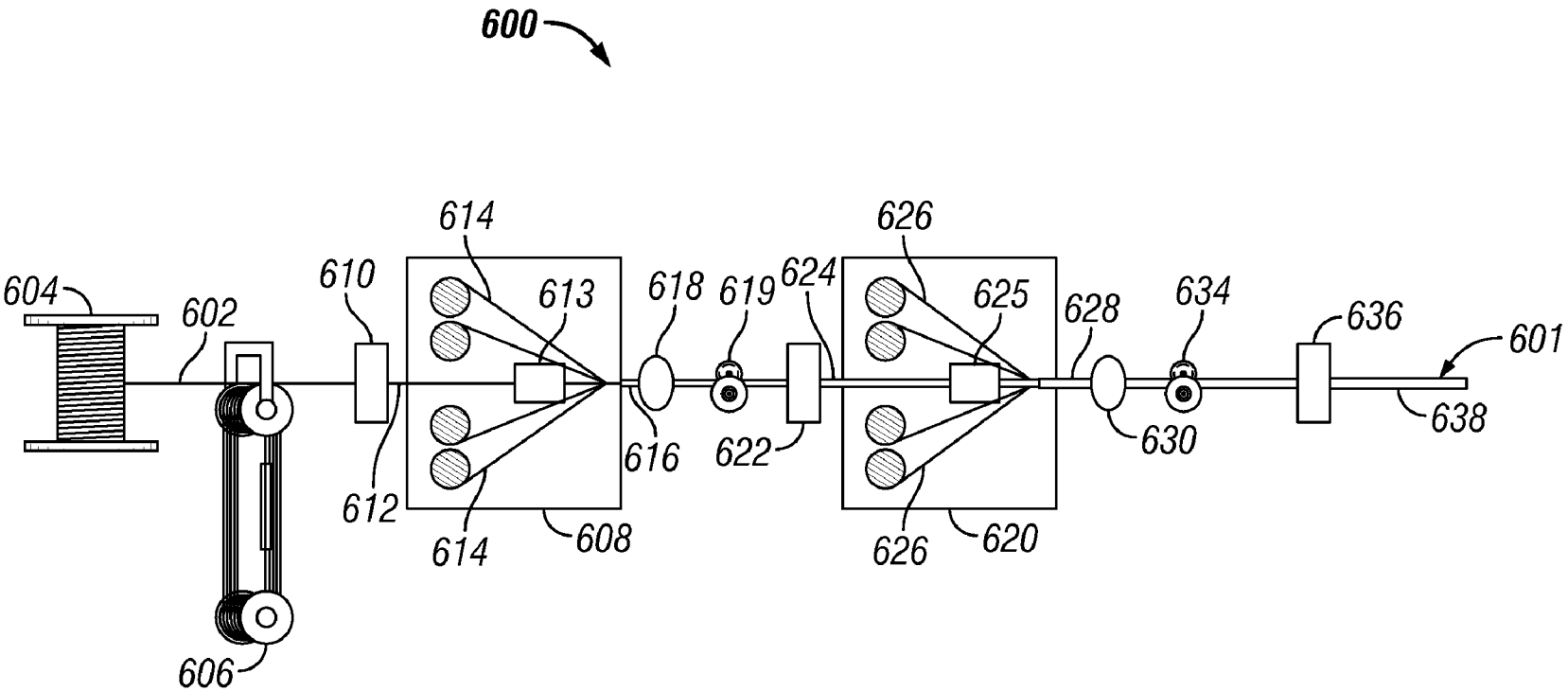
FIG. 10 is a schematic view of a method for forming a cable.

Referring now to FIG. 10, a method for forming a cable 601 is indicated generally at 600. The method 600 begins by providing a pre-manufactured cable core 602 that is placed on or wound upon a spool 604. The cable core 602 is fed from the spool 604 and passes through a cable dancer 606 to help maintain consistent tension during the jacketed armor wire process or method 600. Immediately before entering an armor machine (such as a planetary armor machine 608 shown in FIG. 10), the cable core 602 passes through an extruder 610 where a layer of preferably carbon-fiber-reinforced Tefzel® 612 is applied to the cable core 602. Those skilled in the art will appreciate the layer 612 may be formed from other materials such as, but not limited to, reinforced or non-reinforced fluoropolymers such as MFA, PFA, FEP, ETFE or the like, or polyethelenes, PPEK, PED, PPS, or modified PPS, or combinations thereof.

Figure 11:
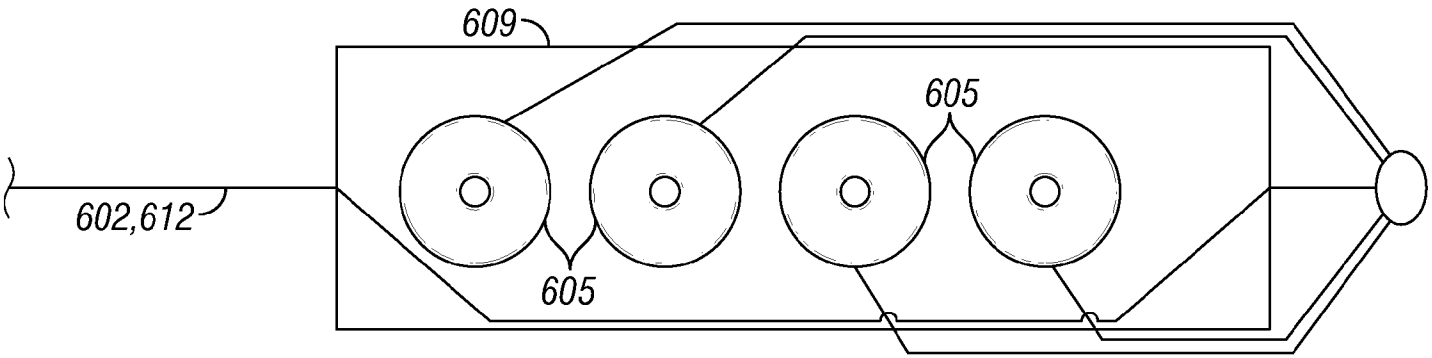
FIG. 11 (Prior Art)
FIG. 11 is a schematic view of an armoring machine of the prior art.
Figure 12:
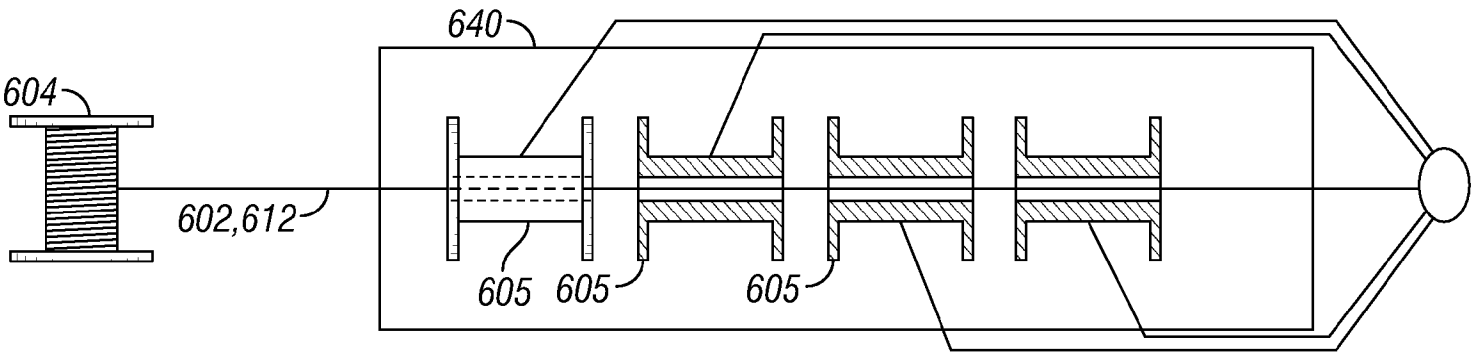
FIG. 12 is a schematic view of an armoring machine usable with the method of FIG. 10.

The 612 may be briefly air-cooled or water-cooled before entering the armor machine 608 or a tubular armoring machine 640, shown in FIG. 12. The method 600 may utilize the tubular armor machine 640 that comprises a plurality of spools 605 that each contain a strand or armor wire 614 or 626 spooled or disposed thereon that are disposed within the armor machine 640 and are preferably adapted such that the spools 605 can be turned or rotated about ninety degrees with respect to the housing of the armoring machine 640 to allow the cable core 602/612 to pass through the center of the spools 605, as shown in FIG. 12, thereby allowing the machine 640 to be utilized in a number of different cable forming methods or processes. A prior art tubular armor machine 609, shown in FIG. 11, which comprises a plurality of strand or armor spools 605 each of which are oriented at approximately a right angle to the length of a housing of the machine 609, which requires the cable core 602/612 to be routed to an outer portion or outside of the machine 609 remote from the spools, as will be appreciated by those skilled in the art. The armor machine 640 may be utilized in a manner similar to the armor machine 609, whereby the cable core 602/612 passes to an outside of the machine 640 or whereby the cable core 602/612 passes through the center of the spool or spools 605.

The layer 612 may be passed through an infrared or induction heat source 613 to soften the layer 612. While the layer 612 is still soft, the first layer of armor wire 614 is applied onto and slightly embedded into the polymer layer 612, forming the conductor 616. After the inner armor wires 614 are applied, the conductor 616 passes through a closing eye 618 to firmly embed the armor wires 614 into the layer 612. To further embed the armor wires 614 into the polymer 612 and maintain a circular profile for the cable 601, the conductor 616 passes through a pair of shaping wheels 619. Immediately before entering a second planetary armor machine 620 (or a second tubular armor machine such as the armor machine 640 shown in FIG. 12), the conductor 616 passes through an extruder 622 where a layer 624 of preferably carbon-fiber reinforced Tefzel® is applied. The layer 624 may be briefly air-cooled and/or water-cooled before entering the second tubular armoring machine 620 so that it can pass through a tubular armor machine, such as the tubular armor machine 609 shown in FIG. 11, to allow the layer 624 to remain stable enough to traverse the outside of the rotating tube on the tubular armor machine 609.

The polymer layer 624 may be passed through an infrared or induction heat source 625 to soften the layer 624. While the preferably carbon-fiber-reinforced Tefzel® layer 624 is still soft, a second layer of armor wire 626 is applied onto and slightly embedded into the polymer 624 to form a conductor 628. After the outer armor wires 626 are applied, the conductor 628 passes through a closing eye 630 to firmly embed the armor wires 626 into the carbon-fiber-reinforced Tefzel® 624. To further embed the outer armor wires 626 into the polymer 624 and maintain a circular profile for the cable 601, the conductor 628 passes through an infrared or induction heat source (not shown), such as the heat sources 108, 116, 216, 318, 406, 414, 503, 514, 524, 532, 540, or 546, before passing through a pair of shaping wheels 634. The conductor 628 then passes though a final extruder 636 where an outer jacket 638 of pure Tefzel® or carbon-fiber-reinforced Tefzel® is applied to complete the cable 601. Alternatively, the conductor 628 can be collected on a spool (not shown) after passing through the shaping wheels 634 and the final jacket layer 638 may be applied in a separate production run. FIG. 10, therefore, illustrates a method 600 that may be utilized to manufacture, for example, a gas-blocked monocable in a single production line.

The methods 100, 200, 300, 400, 500, and 600 may be utilized to produce cables, such as the cables 101, 201, 301, 401, 501, or 601 to fill interstitial spaces in metallic elements of oil exploration and other cables. The methods 100, 200, 300, 400, 500, and 600 may be used to fill interstitial spaces between stranded conductors, served shield conductors, or armor wire strength members in monocables, coaxial cables, hepta cables, seismic cables, or other cables.

The insulation for the layers 104, 204, 304, or 504 for the central strands 102, 202, 302, or 502 may be formed from any suitable insulating material including, but not limited to, polyolefin (such as ethylene-polypropylene copolymer), or fluoropolymers (such as MFA, PFA, Tefzel®). The insulation for the layers 118, 218, 320, 416, or 516, over the helical stranded conductors may be formed from, but are not limited to, one or more of the following: PEEK, PEK, Parmax B. PPS, modified PPS, polyolefin (such as ethylene-polypropylene copolymer), fluoropolymer (such as MFA, PFA, Tefzel), and the like. Similarly, for served coaxial cables, the insulation material for the layer 403 under the served shield may be any of those specified for helical stranded conductors above. Similarly, the layer 416 for the jacket over the served shield may be the same material used for the insulation or may be any other compatible material chosen from the materials listed for coaxial cables. Depending on the materials chosen, the insulation and jacket may or may not be bonded.

For seismic cables, the layers 104, 204, 304, or 504 and the layers 118, 218, 320, 416, or 516 may be formed from nylon 11 or 12, or any other nylon, polyurethane, hytrel, santoprene, polyphenylene sulfide (PPS), polypropylene (PP), or ethylene-polypropylene copolymer (EPC) or a combination of one or more polymers bonded by means of a tie layer.

For heptacables, jacket materials may be bonded continuously from the cable core 104, 204, 304, or 504 to the outermost jacket 118, 218, 320, 416, or 548 for rip resistance. Beginning with the optional tape around the cable core 105, 205, 305, or 505, all materials may be selected so that they will bond chemically with one another. Short carbon fibers, glass fibers, or other synthetic fibers may be added to the jacket 118, 218, 320, 416, 516, 534, 548, 601, 612, or 624 materials to reinforce the thermoplastic or thermoplastic elastomer and provide protection against cut-through. In addition, graphite, ceramic or other particles may be added to the polymer matrix of the outer jacket 118, 218, 320, 416, 516, 534, 548, 601, 612, or 624 to increase abrasion resistance.

A protective polymeric coating may be applied to each strand of armor wire 522, 538, 614, and 626 for corrosion protection. The following coatings may be used but are not limited to : fluoropolymer coating FEP, Tefzel®, PFA, PTFE, MFA; PEEK or PEK with fluoropolymer combination; PPS and PTFE combination; Latex or Rubber Coating. Each strand of armor wire 522, 538, 614, and 626 may also be plated with a (for example) 0.5 mm to 3.0 mm metallic coating which may enhance bonding of the armor wires to the polymeric jacket materials. The plating materials may include, but are not limited to: ToughMet® (a high-strength, copper-nickel-tin alloy manufactured by Brush Wellman); Brass; Copper; Copper alloy, zinc, nickel, combinations thereof; and the like.

The jacket 118, 218, 320, 416, or 516 material and armor wire 522, 538, 614, or 626 coating material may be selected so that the armor wires 522, 538, 614, or 626 are not bonded to and can move within the jacket material 118, 218, 320, 416, or 516. Jacket materials 118, 218, 320, 416, or 516 may include polyolefins (such as EPC or polypropylene), fluoropolymers (such as Tefzel®, PFA, or MFA), PEEK or PEK, Parmax, and PPS. In some instances, virgin polymers have not sufficient mechanical properties to withstand 25,000 lbs of pull or compressive forces as the wireline cable 101, 201, 301, 401, 401, 501 or 601 is pulled over sheaves. Materials may be virgin polymers amended with short fibers. The fibers may be carbon, fiberglass, ceramic, Kevlar®, Vectran®, quartz, nanocarbon, or any other suitable synthetic material. The friction for polymers amended with short fibers may be significantly higher than that of virgin polymer. To provide lower friction, a layer of about 1.0 mm to about 15.0 mm of virgin polymer material may be added over the outside of the fiber-amended jacket.

Particles can be added to fluoropolymers or other polymers to improve wear resistance and other mechanical properties. This can be in the form of a about 1.0 mm to about 15.0 mm jacket applied on the outside of the jacket or throughout the jacket's polymer matrix. The particles may include: Ceramer™; Boron Nitride; PTFE; Graphite; or any combination of the above. As an alternative to Ceramer™, fluoropolymers or other polymers may be reinforced with nanoparticles to improve wear resistance and other mechanical properties, such as, but not limited to, an about 1.0 mm to about 10.0 mm jacket applied on the outside of the jacket or throughout the jacket's polymer matrix. Nanoparticles may include nanoclays, nanosilica, nanocarbon bundles, or nanocarbon fibers.

The materials and material properties for the layers and the armor wires may be selected from those materials recited in commonly assigned U.S. Pat. Nos. 6,600,108, 7,170,007 and 7,188,406, the entire disclosures of which are incorporated by reference herein in their entirety.

The heat sources 108, 116, 216, 318, 406, 414, 503, 514, 524, 532, 540, or 546 may be one of, or combinations of, exposure to an electromagnetic radiation source or electromagnetic heating, which may be achieved using one or any combination of infrared heaters emitting short, medium or long infrared waves, ultrasonic waves, microwaves, lasers, and other suitable electromagnetic waves, as will be appreciated by those skilled in the art.

The armor wires 522, 538, 614, or 626 or conductors 106, 206, 306, 404, or 506 may be heated prior to embedding into the layers by, in non-limiting examples, induction heating of metal, ultrasonic heating, or thermal heating using radiation or conduction, as will be appreciated by those skilled in the art.

The above-mentioned methods 100, 200, 300, 400, 500, and 600 are examples of some approaches, which may be used alone, or in combination, to embed metallic elements in to cable insulation layers or jackets or insulation as described above.

In the above-mentioned methods 100, 200, 300, 400, 500, and 600, wire elements (such as helical conductor strands, served shield wires, or armor wires) are cabled onto polymer-encased central elements (such as central conductor strands, insulated conductors or cable cores) at a given coverage into a slightly melted or softened insulation, allowing the cabled wires to embed themselves in the insulation. As the cabled wires embed, they achieve a greater coverage at a smaller circumference. Correspondingly, a shorter length of cabled wire elements is required to cover the smaller circumference.

For example, on a monocable, served shield wires might be cabled onto a central insulated conductor at a coverage between about 80% and about 85%. Within a few inches or feet, the cable passes through an electromagnetic heat source to soften the insulation, and the served wires embed themselves in the insulation. Because the wires are now distributed around a smaller circumference, coverage increases to between 93 and 98%. Over the length of a wireline cable, cabling at the smaller diameter also requires significantly less length.

Assume a monocable is assembled by applying 0.0323 inch diameter armor wires at a 22 degree lay angle over a jacket with an initial diameter of 0.124 in, as shown in the equations and calculations listed below. The total initial diameter is 0.1866 in. The jacket is then softened to allow the armor wire to partially embed into the jacket, such that the resulting total diameter is 0.1733 in. As described in the calculations below, the length of armor wire required to wrap around the core at the 22 degree lay angle is 10.16% shorter at the smaller diameter. Over a 24,000-ft. monocable, this is a difference of approximately 2,440 ft. for each armor wire, as shown in the equations and calculations listed below.

Coverage and excess length equations for a hypothetical monocable are listed below:

$$D = \text{pitch diameter}$$

$$D = D_c + d_w$$

$$D_c = \text{Diameter of core}$$

$$d_w = \text{Diameter of armor wire}$$

$$\begin{aligned} C_1 &= \text{Total circumference at pitch diameter} \\ &= \pi(D_c + d_w) \\ &= \pi D \end{aligned}$$

$$C_2 = \text{Total metal circumference at pitch diameter}$$

$$m = \text{Number of metal elements}$$

$$C_2 = m \times \frac{d_w}{\cos\alpha}$$

$$C_{\%} = \text{Metal coverage at the pitch diameter}$$

$$C_{\%} = \frac{m d_w}{\pi D \cos\alpha} \times 100$$

$$D_a = \text{Initial diameter}$$

$$\begin{aligned} D_a &= 0.124 \text{ in.} + 0.0323 \text{ in.} \\ &= 0.1563 \text{ in.} \end{aligned}$$

$$\lambda_a = \text{Length of one wrap of armor wire at } D_a$$

$$\begin{aligned} \lambda_a &= \frac{\pi \times 0.1563 \text{ in.}}{\tan 22} \\ &= 1.22 \end{aligned}$$

$$D_b = \text{Final diameter}$$

$$\begin{aligned} D_b &= 0.109 \text{ in.} + 0.0323 \text{ in.} \\ &= 0.141 \text{ in.} \end{aligned}$$

$$\lambda_b = \text{Length of one wrap of armor wire at } D_b$$

-continued $$\begin{aligned} \lambda_b &= \frac{\pi \times 0.141 \text{ in.}}{\tan 22} \\ &= 1.096 \text{ in.} \end{aligned}$$

$$\lambda_b = \text{Length of one wrap of armor wire at } D_b$$

$$\lambda_b = \frac{\pi \times 0.141}{\tan 22}$$

$$1.096$$

$$\therefore$$

$$\frac{\Delta\lambda}{\lambda_a} = \text{Difference in lay length as fraction of } \lambda_a$$

$$\begin{aligned} \frac{\Delta\lambda}{\lambda_a} &= \frac{0.124}{1.22} \\ &= 10.16\% \end{aligned}$$

$$L_a = 24{,}000 \text{ ft}$$

$$\begin{aligned} L_b &= (0.1016 \times 24{,}000 \text{ ft.}) + 24{,}000 \text{ ft.} \\ &= 26{,}439 \text{ ft.} \end{aligned}$$

$$\Delta L = L_b - L_a$$

$$\therefore$$

$$\begin{aligned} \Delta L &= 26{,}439 \text{ ft.} - 24{,}000 \text{ ft.} \\ &= 2439 \text{ ft.} \end{aligned}$$

This length could obviously not be taken out of a 24,000-foot cable after the armor wire had been completed. The methods or processes described herein are only possible because the excess length is taken up by tension at the armor wire spools as the diameter is reduced. The rate of speed of payoff of the armor wire from the spools is slowed to account for the excess length "going back" to the spools.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

I claim:

1. A method of forming at least a portion of a cable, comprising:

providing at least one conductor;

extruding at least an inner layer of polymeric insulation over the at least one conductor to form a cable conductor core;

embedding a plurality of conductors into the inner layer of the cable conductor core; and extruding an outer layer of polymeric insulation over the cable conductor core and the plurality of conductors and bonding the inner layer to the outer layer to form the cable and provide a contiguous bond between the inner layer, the conductors, and the outer layer, wherein embedding comprises heating a one of the inner layer and the conductors prior to embedding the conductors into the inner layer.

2. The method according to claim 1, wherein heating comprises extruding the inner layer over the at least one conductor and substantially immediately thereafter embedding the plurality of conductors into the freshly extruded inner layer.

3. The method according to claim 1, wherein heating comprises heating the inner layer substantially immediately prior to embedding.

4. The method according to claim 1, further comprising cooling the inner layer prior to embedding.

5. The method according to claim 1, wherein heating comprises heating the plurality of conductors substantially immediately prior to embedding.

6. The method according to claim 5, wherein heating the plurality of conductors comprises utilizing a heat induction/shaping device.

7. The method according to claim 1, wherein the at least one conductor comprises a single uninsulated strand.

8. The method according to claim 1, wherein the at least one conductor comprises a plurality of conductors.

9. The method according to claim 1, wherein the plurality of conductors comprise one of uninsulated electrical conductors, shield layers, and armor wire layers.

10. A method of forming a cable, comprising:

providing at least one conductor cable core having at least an inner layer of polymeric insulation disposed over at least one conductor;

providing a plurality of conductors;

heating a one of the inner layer and the plurality of conductors;

embedding the plurality of conductors into the inner layer of the cable conductor core substantially immediately after heating; and extruding an outer layer of polymeric insulation over the cable conductor core and the plurality of conductors and bonding the inner layer to the outer layer to form the cable and provide a contiguous bond between the inner layer, the conductors, and the outer layer.

11. The method according to claim 10, wherein heating comprises exposing the inner layer to an electromagnetic radiation source.

12. The method according to claim 10, wherein heating comprises heating the plurality of conductors utilizing a heat induction/shaping device.

13. The method according to claim 10, further comprising cooling the inner layer prior to embedding.

14. The method according to claim 10, wherein the plurality of conductors comprise one of uninsulated electrical conductors, shield layers, and armor wire layers.

15. The method according to claim 10, further comprising providing a second plurality of conductors;

heating a one of the outer layer and the second plurality of conductors;

embedding the second plurality of conductors into the outer layer of the cable substantially immediately after heating; and extruding a second outer layer of polymeric insulation over the cable and the second plurality of conductors and bonding the outer layer to the second outer layer to form the cable and provide a contiguous bond between the inner layer, the conductors, and the outer layer, the second conductors, and the second outer layer.

16. A method of forming a cable, comprising:

providing a conductor strand;

extruding a first layer of polymeric insulation over the conductor strand to form a cable conductor core;

embedding a first plurality of conductors into the first layer of the cable conductor core substantially immediately after extruding the first layer;

extruding a second layer of polymeric insulation over the cable conductor core and the plurality of conductors and bonding the inner layer to the second layer to provide a contiguous bond between the inner layer, the conductors, and the second layer;

providing a second plurality of conductors;

heating one of the second layer and the second plurality of conductors;

embedding the second plurality of conductors into the second layer substantially immediately after heating;

extruding a third layer of polymeric insulation over the second layer and the second plurality of conductors and bonding the third layer to the second layer to provide a contiguous bond between the second layer, the second conductors, and the third layer;

providing a third plurality of conductors;

heating one of the third layer and the third plurality of conductors;

embedding the third plurality of conductors into the third layer substantially immediately after heating; and extruding a fourth layer of polymeric insulation over the third layer and the third plurality of conductors and bonding the fourth layer to the third layer to form the cable and provide a contiguous bond between each of the layers and the conductors.

17. The method according to claim 16, wherein heating comprises extruding the second and third layers over the second and third conductors and substantially immediately thereafter embedding the conductors into the freshly extruded second and third layers.

18. The method according to claim 16, wherein heating comprises exposing the second and third layers to an electromagnetic radiation source.

19. The method according to claim 16, wherein heating comprises heating the second and third plurality of conductors prior to embedding.

20. The method according to claim 19, wherein heating the second and third conductors comprises utilizing a heat induction/shaping device.

21. The method according to claim 16, wherein the conductor strand comprises a single uninsulated strand.

22. The method according to claim 16, wherein the first plurality of conductors comprises uninsulated electrical conductors.

23. The method according to claim 16 wherein the first plurality of conductors comprises shield layers.

24. The method according to claim 16 wherein the second plurality of conductors comprises shield layers.

25. The method according to claim 16, wherein the second and third plurality of conductors comprise armor wire layers.

26. The method according to claim 16 further comprising cooling the second and third layers prior to heating.

27. A method of forming a cable, comprising:

providing at least one conductor cable core;

extruding an inner layer of polymeric insulation over the conductor cable core;

providing a plurality of conductors;

heating a one of the inner layer and the plurality of conductors;

embedding the plurality of conductors into the inner layer of the cable conductor core substantially immediately after heating; and extruding an outer layer of polymeric insulation over the inner layer and the plurality of conductors and bonding the inner layer to the outer layer to form the cable and provide a contiguous bond between the inner layer, the conductors, and the outer layer.

28. The method according to claim 27, wherein heating comprising exposing the inner layer to an electromagnetic radiation source.

29. The method according to claim 27, wherein heating comprises heating the plurality of conductors prior to embedding.

30. The method according to claim 29, wherein heating the plurality of conductors comprises utilizing a heat induction/shaping device.

31. The method according to claim 27, wherein the plurality of conductors comprise one of uninsulated electrical conductors, shield layers, and armor wire layers.

32. The method according to claim 27, wherein the at least one conductor core comprises a one of a monocable, a coaxial cable, a triad cable, a quad cable, a hepta cables, and a seismic cable.

33. The method according to claim 32, wherein the at least one conductor core comprises a tape layer disposed on an outer portion thereof.

34. The method according to claim 27, further comprising providing a second plurality of conductors;

heating a one of the outer layer and the second plurality of conductors;

embedding the second plurality of conductors into the outer layer of the cable substantially immediately after heating; and extruding a second outer layer of polymeric insulation over the outer layer and the second plurality of conductors and bonding the outer layer to the second outer layer to form the cable and provide a contiguous bond between the inner layer, the conductors, and the outer layer, the second conductors, and the second outer layer.

* * * * *